US008979714B2

(12) United States Patent
Miller

(10) Patent No.: US 8,979,714 B2
(45) Date of Patent: Mar. 17, 2015

(54) ELLIPTICAL EXERCISE DEVICE

(71) Applicant: Larry D. Miller, Rochester, MI (US)

(72) Inventor: Larry D. Miller, Rochester, MI (US)

(73) Assignee: Larry D. Miller Trust, Rochester, MI (US)

( * ) Notice: Subject to any disclaimer, the term of this patent is extended or adjusted under 35 U.S.C. 154(b) by 0 days.

(21) Appl. No.: 14/083,099

(22) Filed: Nov. 18, 2013

(65) Prior Publication Data

US 2014/0336007 A1 Nov. 13, 2014

Related U.S. Application Data

(63) Continuation-in-part of application No. 13/942,119, filed on Jul. 15, 2013.

(60) Provisional application No. 61/881,097, filed on Sep. 23, 2013, provisional application No. 61/870,409, filed on Aug. 27, 2013, provisional application No. 61/820,312, filed on May 7, 2013.

(51) Int. Cl.
*A63B 22/04* (2006.01)
*A63B 22/00* (2006.01)

(52) U.S. Cl.
CPC ..... *A63B 22/04* (2013.01)
USPC ..... 482/52; 482/51

(58) Field of Classification Search
USPC ..... 482/51–53, 57, 70, 71, 79, 80
See application file for complete search history.

(56) References Cited

U.S. PATENT DOCUMENTS

| | | | | |
|---|---|---|---|---|
| 5,518,473 | A | 5/1996 | Miller | |
| 5,611,756 | A | 3/1997 | Miller | |
| 5,766,113 | A * | 6/1998 | Rodgers, Jr. | 482/52 |
| 5,911,649 | A * | 6/1999 | Miller | 482/52 |
| 6,045,487 | A | 4/2000 | Miller | |
| 6,579,210 | B1 * | 6/2003 | Stearns et al. | 482/52 |
| 6,689,019 | B2 * | 2/2004 | Ohrt et al. | 482/52 |
| 7,507,184 | B2 | 3/2009 | Rodgers, Jr. | |
| 7,556,591 | B2 | 7/2009 | Chuang et al. | |
| 7,678,025 | B2 | 3/2010 | Rodgers, Jr. | |
| 7,708,668 | B2 | 5/2010 | Rodgers, Jr. | |
| 7,811,208 | B2 | 10/2010 | Rodgers, Jr. | |
| 7,828,698 | B2 | 11/2010 | Rodgers, Jr. | |
| 7,862,482 | B1 | 1/2011 | Hsu | |
| 7,878,947 | B1 | 2/2011 | Rodgers, Jr. | |

(Continued)

FOREIGN PATENT DOCUMENTS

EP 2327455 A1 6/2011

OTHER PUBLICATIONS

International Search Report and Written Opinion for co-pending application Serial No. PCT/US2014/037133, dated Oct. 2, 2014.

*Primary Examiner* — Stephen Crow
*Assistant Examiner* — Gregory Winter
(74) *Attorney, Agent, or Firm* — Gifford, Krass, Sprinkle, Anderson & Citkowski, P.C.; Douglas L. Wathen

(57) ABSTRACT

An elliptical exercise device includes a frame supporting guide links which provide for a horizontal component of motion of associated foot support links. A mechanical coupling couples the foot support links to a crank system and intermediate links couple the crank system to the guide links such that a foot receiving area of each foot support link moves in a closed generally elliptical path when the crank system rotates.

80 Claims, 8 Drawing Sheets

(56) References Cited

U.S. PATENT DOCUMENTS

| | | | | |
|---|---|---|---|---|
| 7,988,600 | B2 | 8/2011 | Rodgers, Jr. | |
| 8,021,275 | B2 | 9/2011 | Rodgers, Jr. | |
| 8,092,351 | B1 | 1/2012 | Rodgers, Jr. | |
| 8,303,470 | B2 | 11/2012 | Stewart et al. | |
| 8,317,663 | B2 | 11/2012 | Stewart et al. | |
| 2009/0203501 | A1 | 8/2009 | Rodgers, Jr. | |
| 2013/0231217 | A1* | 9/2013 | Miller | 482/52 |
| 2014/0296036 | A1* | 10/2014 | Miller | 482/52 |

* cited by examiner 1
2
3
4
5
6
7
8
9
81
82
80
84
86
92
94
90
88

1
2
3
4
5
6
7
8
9
96
100
98

ELLIPTICAL EXERCISE DEVICE

CROSS-REFERENCE TO RELATED APPLICATIONS

This application is a continuation-in-part of U.S. patent application Ser. No. 13/942,119, filed Jul. 15, 2013, which claims the benefit of U.S. provisional patent application No. 61/820,312, filed May 7, 2013. This continuation-in-part application also claims priority to U.S. provisional patent application Nos. 61/870,409, filed Aug. 27, 2013, and 61/881,097, filed Sep. 23, 2013, the contents of all of which are incorporated herein by reference.

FIELD OF THE INVENTION

This invention relates to elliptical exercise devices in which the path of travel of a user's foot is generally elliptical.

BACKGROUND OF THE INVENTION

There are a number of exercise devices that operate to allow a user to implement a foot action following a generally closed, curved path of travel, simulating running and/or walking. These devices are generally referred to as "elliptical" exercise devices. Many such elliptical exercise devices are large, complicated, costly, and/or have undesirable characteristics related to the motion of the user's feet.

U.S. Pat. No. 5,518,473 to Miller shows an early design for an elliptical exercise device. The device provides a path of travel that simulates running and/or walking but is quite large and does not provide for arm exercise.

U.S. Pat. No. 5,611,756 to Miller discloses a elliptical exercise device with arm and leg movement. A pair of guide links are pivotally supported on a frame and a foot engaging link is supported at the lower end of each guide link. An intermediate link connects each guide links to crank. A control link joins each foot link to the corresponding intermediate link to vary the angle of the foot link relative to the guide link.

U.S. Pat. No. 6,045,487 to Miller discloses an elliptical exercise device having a pair of guide links pivotally supported on a frame and a foot link supported at the lower end of each guide link. An intermediate link connects each guide link to a crank of a crank system. A flexible control member engages each foot link and extends up and over a pulley located at the guide link pivot axis. The control members connect to a reciprocating assembly for moving the foot links up and down as the guide links pivot back and forth.

U.S. Pat. No. 7,708,668 to Rodgers, Jr. shows several embodiments of an exercise device having flexible elements coupling left and right foot support members to a crank system. The exercise device allows for a variable stride length and decouples the vertical and horizontal components of foot travel.

U.S. Pat. No. 7,556,591 to Chuang et al. discloses an exercise device with cranks mounted to an upper portion of a frame. Two handles are pivoted to the frame forward of the cranks. Foot supports are pivotally coupled to the lower ends of the handles. Pivot rods extend between each foot support and one of the cranks. Additional links connect each handle with the same cranks as the respective pivot rod.

SUMMARY OF THE INVENTION

The present invention offers several embodiments of an elliptical exercise device. Some embodiments offer a path of motion with desirable characteristics. In addition, some embodiments are compact in form and have reduced mechanical complexity.

A first embodiment of an elliptical exercise device includes a frame configured to be supported on a horizontal surface. The frame has a first pivot axis and a second pivot axis defined thereon. A first and a second guide link each have a first and a second attachment point defined thereon. Each guide link is pivotally attached, through its first attachment point, to the frame at the first pivot axis thereof. A first and a second foot link are each configured to support a user's foot thereon. Each foot support link is pivotally connected to the second attachment point of a respective one of the guide links so that when the guide links reciprocate relative to the frame they each cause their respective foot support link to move in a path of travel having a substantially horizontal component of motion. A crank system is pivotally attached to the frame at the second pivot axis thereof. The crank system is rotatable about the second pivot axis. A first and a second mechanical coupling each couple a respective one of the foot support links to the crank system such that rotation of the crank system about the second pivot axis moves the foot support links in a path of travel having a substantially vertical component of motion. Each mechanical coupling includes a foot support portion extending upwardly from a respective one of the foot support links to a vertical control guide. Each vertical control guide is disposed rearwardly of the first and second pivot axes and above the second pivot axis. A first and a second intermediate link each have a first end coupled to the crank system and a second end connected to a respective one of the guide links such that rotation of the crank system about the second pivot axis causes the respective first and second guide links to pivot about the first pivot axis such that the foot support links move in the path of travel having a substantially horizontal component of motion. The mechanical couplings and the intermediate links are coupled to the crank system such that the horizontal component of motion and the vertical component of motion of the foot support links are out of phase, wherein when the horizontal component of motion of each foot support link is at its forwardmost or rearwardmost limit, the vertical component of motion of the same foot support link is approximately midway between its uppermost and lowermost limit. In operation, a foot receiving area of each foot support link moves in a generally elliptical path when the crank system rotates about the second pivot axis.

In particular embodiments, each vertical control guide is disposed on the frame and in some versions each vertical control guide is defined by a pulley rotationally mounted on the frame. Each mechanical coupling may be a flexible element having one end interconnected to the crank system, a second end interconnected to a respective one of the foot support links, and a mid portion extending over one of the vertical control guides on the frame.

The frame may be said to have a forward portion forward of the first pivot axis and a rearward portion rearward of the first pivot axis. In particular embodiments, a first and a second forward pulley are supported on the forward portion of the frame, with the mid portion of each of the flexible elements further extending over a respective one of the forward pulleys. The first end of each flexible element extends rearwardly from the respective forward pulley to the crank system. Some versions further include a first and a second upper pulley supported on the forward portion of the frame and above the forward pulleys, and the mid portion of each of the flexible elements further extends over a respective one of the upper pulleys. In some versions, the intermediate links extend generally vertically upwardly from the crank system.

In particular embodiments, a first and a second upper pulley is supported on the forward portion of the frame above the second pivot axis and the midportion of each of the flexible elements extends over a respective one of the upper pulleys. The first end of each flexible element extends downwardly from the respective upper pulley to the crank system. In some versions, the intermediate links extend generally vertically upwardly from the crank system. The cranks system may include four attachment points disposed approximately 90 degrees apart and the first ends of the mechanical couplings are coupled to two of the attachment points and the first ends of the intermediate links are coupled to the other two attachment points. In some versions, the intermediate links extend generally rearwardly from the crank system.

In particular embodiments, the first end of each flexible element is interconnected to the crank system by being connected to one of the intermediate links.

In particular embodiments, the cranks system includes a first and a second crank arm and the first end of each of the flexible elements is directly connected to one of the crank arms. In some versions, the first end of each intermediate link is connected to the same crank arm as the corresponding flexible element.

In particular embodiments, the cranks system includes attachment points and the mechanical couplings each have a first end directly connected to one of the attachment points. In some versions, the first end of each intermediate link is directly connected to one of the attachment points.

In particular embodiments, the intermediate links extend generally vertically. In some versions, each of the guide arms has a connecting portion extending forwardly to a third attachment point and the first end of each of the intermediate links is connected to the third attachment point of a respective one of the guide arms.

In particular embodiments, the foot support portions of the mechanical couplings extend generally vertically when the foot support links are at a middle position.

In particular embodiments, a first and second bell crank are coupled to the crank system, and the intermediate links are coupled to the crank system by being coupled to the bell cranks.

In particular embodiments, each mechanical coupling includes a rocker arm pivotally interconnected with the frame. The rocker arm has a first end coupled to the crank system and a second end coupled to a respective one of the foot support portions. The second end may define the vertical control guide. In some versions, the mechanical coupling further includes a flexible element extending from a respective one of the foot support links to a respective vertical control guide of the respective rocker arm.

In particular embodiments, the foot support links are generally horizontal and the connection between each foot support link and the respective one of the guide links is at a forward end of the support link. The foot receiving area is defined at a rearward end of each foot support link and the foot support portion of each mechanical coupling is connected to a mid portion of a respective one of the foot support links.

In certain embodiments, the guide links have a working length defined between the first attachment point and the second attachment point and the intermediate links have a length that is at least 80% of the guide link working length. In some versions, the intermediate links extend generally vertically.

In particular embodiments, the substantially horizontal component of motion of each foot support link has a higher acceleration when the foot support link is at a forward end of travel than when the foot support link is at a rearward end of travel.

In particular embodiments, the vertical height of the vertical component of motion is adjustable. In some versions, the connection between each mechanical coupling and the crank system is adjustable with respect to the second pivot axis so as to change the vertical height of the vertical component of motion.

In particular embodiments, the horizontal length of the horizontal component of motion is adjustable. In some versions, each of the guide arms has a third attachment point defined thereon. The first end of each of the intermediate links is connected to the third attachment point of a respective one of the guide arms and the third attachment points are adjustable so as to change a horizontal length of the elliptical path.

In particular embodiments, the guide links each include hand portions extending upwardly from the first attachment point.

In some embodiments, the crank system has a first and a second crank arm. The first end of each intermediate link is connected to a respective one of the crank arms and each of the mechanical couplings is coupled to a respective one of the crank arms.

In particular embodiments, a retraction mechanism is provided for changing the effective length of the mechanical couplings such that the position of each foot support link relative to the corresponding guide link may be altered, thereby altering a motion profile of each foot receiving area. In some versions, the retraction mechanism has a first and second intermediate pulley each engaging one of the mechanical couplings and moveable so as to change the effective length of the mechanical coupling.

In particular embodiments, the foot support portion of each mechanical coupling is connected to the corresponding foot support link at a coupling attachment point. Each guide link and the corresponding foot support portion of the respective mechanical coupling are generally parallel to each other and the corresponding first attachment point, second attachment point, vertical control guide and coupling attachment point generally form a parallelogram.

In another embodiment of the present invention, the elliptical exercise device includes a frame configured to be supported on a horizontal surface. The frame has a first pivot axis, a second pivot axis, and a first and second vertical control guide defined thereon. Each vertical control guide is disposed rearwardly of the first and second pivot axes. A first and a second guide link each have a first and a second attachment point defined thereon. Each guide link is pivotally attached, through its first attachment point, to the frame at the first pivot axis thereof. A first and a second foot support link are each configured to support a user's foot thereupon. Each foot support link is pivotally connected to the second attachment point of a respective one of the guide links so that when the guide links reciprocate relative to the frame, they each cause their respective foot support link to move in a path of travel having a substantially horizontal component of motion. A crank system is pivotally attached to the frame at the second pivot axis thereof. The crank system is rotatable about the second pivot axis. A first and a second flexible coupling each couple a respective one of the foot support links to the crank system such that rotation of the crank system about the second pivot axis moves the foot support links in a path of travel having a substantially vertical component of motion. Each flexible coupling includes a foot support portion extending upwardly from a respective one of the foot support links to a respective one of the vertical control guides. A first and a second intermediate link each have a first end coupled to the crank system and a second end coupled to a respective one of the guide links such that rotation of the crank system about the second pivot axis causes the respective first and second guide links to pivot about the first pivot axis such that the foot support links move in the path of travel having a substantially horizontal component of motion. The mechanical couplings and the intermediate links are coupled to the cranks system such that the horizontal component of motion and the vertical component of motion of the foot support links are out of phase, wherein when the horizontal component of motion of each foot support link is at its forwardmost or rearwardmost limit, the vertical component of motion of the same foot support link is approximately midway between its uppermost and lowermost limit. In operation, a foot receiving area of each foot support link moves in a generally elliptical path when the crank system rotates about the second pivot axis.

In a further embodiment of an elliptical exercise device includes a frame configured to be supported on a horizontal surface. The frame has a first pivot axis and a second pivot axis defined thereon. A first and a second guide link each have a first and a second attachment point defined thereon. Each guide link is pivotally attached, through its first attachment point, to the frame at the first pivot axis thereof. A first and a second foot link are each configured to support a user's foot thereon. Each foot support link is pivotally connected to the second attachment point of a respective one of the guide links so that when the guide links reciprocate relative to the frame they each cause their respective foot support link to move in a path of travel having a substantially horizontal component of motion. A crank system is pivotally attached to the frame at the second pivot axis thereof. The crank system is rotatable about the second pivot axis. A first and a second intermediate link each have a first end coupled to the crank system and a second end connected to a respective one of the guide links such that rotation of the crank system about the second pivot axis causes the respective first and second guide links to pivot about the first pivot axis such that the foot support links move in the path of travel having a substantially horizontal component of motion. A first and a second mechanical coupling each couple a respective one of the foot support links to a respective one of the intermediate links such that movement of the intermediate links moves the foot support links in a path of travel having a substantially vertical component of motion. Each mechanical coupling includes a foot support portion extending upwardly from a respective one of the foot support links to a vertical control guide. Each vertical control guide is disposed rearwardly of the first and second pivot axes and above the second pivot axis. The mechanical couplings are coupled to the intermediate links and the intermediate links are coupled to the crank system such that the horizontal component of motion and the vertical component of motion of the foot support links are out of phase, wherein when the horizontal component of motion of each foot support link is at its forwardmost or rearwardmost limit, the vertical component of motion of the same foot support link is approximately midway between its uppermost and lowermost limit. In operation, a foot receiving area of each foot support link moves in a generally elliptical path when the crank system rotates about the second pivot axis.

As will be clear to those of skill in the art, the various elements, details and variations illustrated and discussed with respect to particular embodiments may be combined in different ways and used with other embodiments, in any combination.

DETAILED DESCRIPTION OF THE PREFERRED EMBODIMENTS

The present invention will be explained with reference to some particular embodiments, and it is to be understood that yet other embodiments, modifications, and variations thereof will be apparent to those of skill in the art in view of the teaching presented herein. As will be clear to those of skill in the art, an elliptical exercise device is designed to be used by a user placing each of their feet on a respective foot receiving area and then moving their feet along a closed elliptical path. As such, an elliptical exercise device includes left and right elements for supporting the respective left and right feet of the user. The right and left components of the exercise device are typically substantially the same, though the machine may be constructed such that the two foot receiving areas are 180 degrees out of phase. That is, when one foot receiving area is moving forwardly, the other foot receiving area is moving rearwardly. The present invention will be described primarily with reference to only one set of the components, with it being understood that the corresponding components on the other half of the device are constructed similarly.

Figure 1:
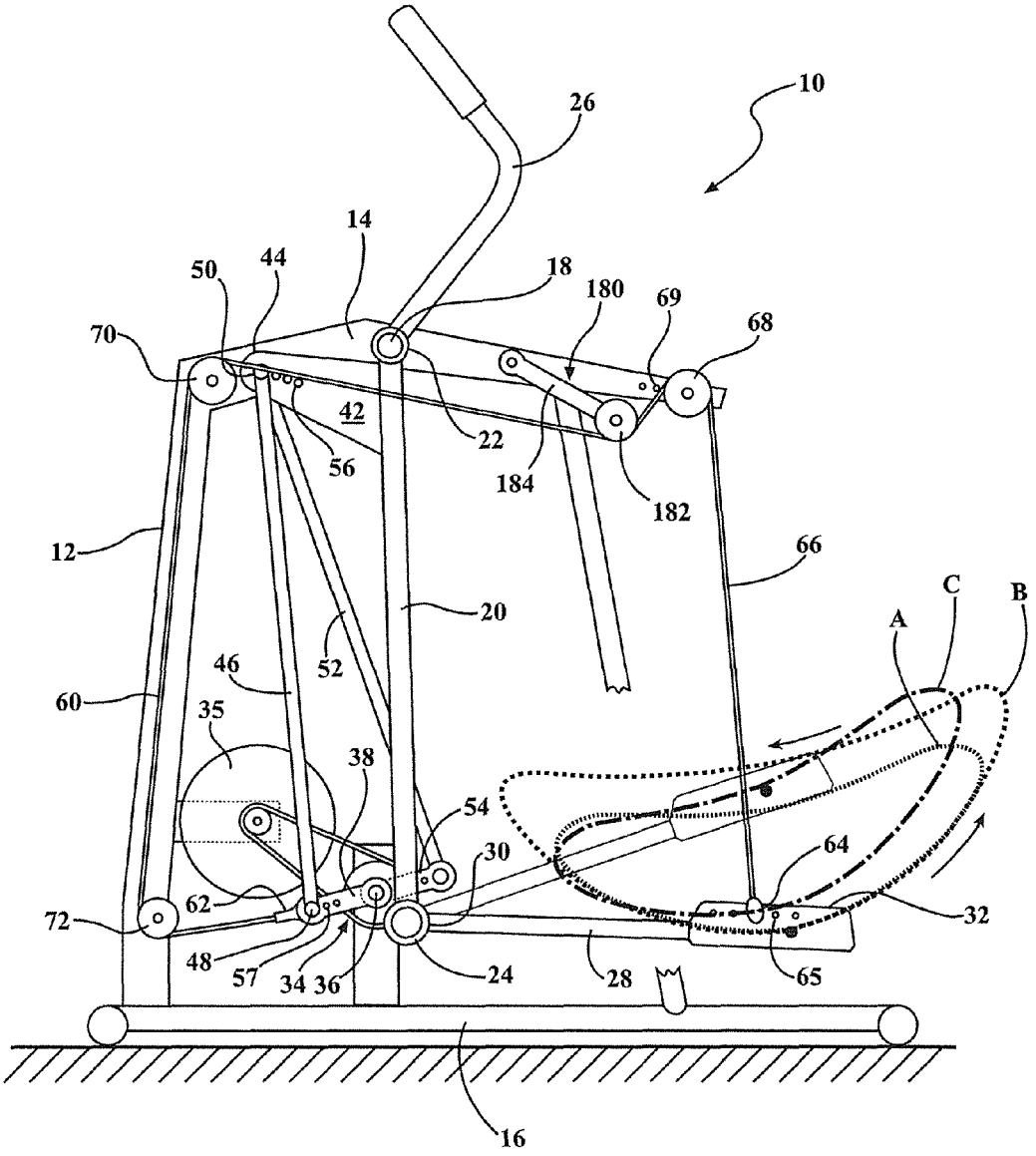
FIG. 1 is a side elevational view of a first embodiment of an elliptical exercise device in accordance with the present invention.

FIG. 1 shows a first embodiment of an elliptical exercise device 10 structured in accord with the principles of the present invention. The device includes a frame 12 which is configured and operative to retain and support the various other components of the device on a horizontal surface such as a floor. The frame 12 is typically fabricated from metal and/or composite materials and/or wood, but any material may be used. The frame 12 has an upper portion 14 and a lower portion 16. The lower portion 16 is configured to contact the horizontal surface while the upper portion 14 supports several components of the device 10. A first pivot axis 18 is defined in a central area of the upper portion 14 of the frame 12. The frame 12 may be send to have said to have a forward portion forward of the first pivot axis, which is to the left in the view of FIG. 1, and a rearward portion rearward of the first pivot axis, which is to the right in the view of FIG. 1.

A pair of guide links are pivotally interconnected with the frame so as to be pivotable about the first pivot axis 18. FIG. 1 is a view of the left side of the exercise device 10 and the left guide link 20 is visible. Because the guide link 20 is shown at the midpoint of its travel, the right guide link is hidden behind it. All left and right components may alternatively be referred to as first and second components for ease of description. The guide link 20 may be said to have a first attachment point 22 towards its upper end and a second attachment point 24 at its lower end. The guide link 20 is pivotally interconnected with the first pivot axis 18 of the frame 12 at its first attachment point 22. In the illustrated embodiment, the guide link 20 further includes a hand portion 26 extending upwardly from the first attachment point 22.

Each guide link 20 has a corresponding foot support link 28 pivotally connected thereto. In the illustrated embodiment, the foot support link 28 has a forward end 30 pivotally interconnected with the second attachment point 24 of the guide link 20. The foot support link 28 further has a foot receiving area 32 defined at its rearward end.

Figure 2:
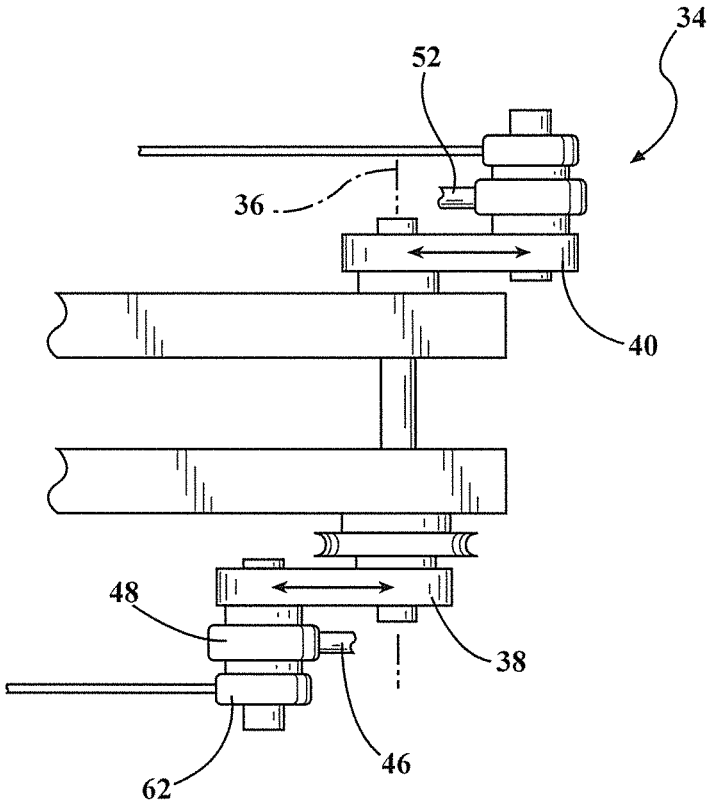
FIG. 2 is a detailed top view of an embodiment of a crank system for use with some versions of the present invention.

A crank system 34 is pivotally interconnected with the frame 12 such that the crank system 34 rotates about a second pivot axis 36 defined on the frame. In the illustrated embodiment, the crank system is disposed adjacent the lower portion 16 of the frame 12 and on the forward portion of the frame. Referring to FIG. 2, a top view of an embodiment of a crank system 34 for use with some embodiments of the present invention is shown. The crank system 34 includes a first crank arm 38 and a second crank arm 40. As will be described, the guide links and the foot support links are coupled to the crank system 34 such that rotation of the crank system causes the foot receiving areas 32 to move in a closed generally elliptical path. A flywheel and/or load element 35 may be interconnected with the crank system 34 for creating an exercise load. Such a load element may take the form of an electrical or frictional resistance device, or any other form. Alternatively, a flywheel and/or load element may be integrated into the crank system 34 or connected to the remainder of the device in other ways.

Referring again to FIG. 1, the guide links 20 each include a connecting portion 42 that extends forwardly from the main body of the guide link just below the first attachment point 22. A third attachment point 44 is defined on this connecting portion 42. An intermediate link 46 has a lower, or first, end 48 connected to the outer end of the crank arm 38 and an upper, or second, end 50 connected to the third attachment point 44 of the connecting portion 42 of the guide link 20. As will be clear to those of skill in the art, as the crank system 34 rotates about the second pivot axis 36, the intermediate link 46 will cause the guide link 20 to pivot about the first pivot axis 18 such that the foot support links move in a path of travel having a substantially horizontal component of motion. A second intermediate link 52 is also illustrated, connected to the second crank arm 54. It causes corresponding, but out of phase, motion of the other guide link. The third attachment point 44 may be adjustable so as to change a horizontal length of the elliptical path of the foot receiving areas 32. In the illustrated embodiment, a plurality of connecting points 56 are provided on the connecting portion 42 and the third attachment point may be defined at any of these locations.

The elliptical exercise device 10 further includes a first and second mechanical coupling each coupling one of the foot support links to the crank system such that rotation of the crank system about the second pivot axis 36 moves the foot support links 28 in a path of travel having a substantially vertical component of motion. In the embodiment of FIG. 1, the mechanical coupling takes the form of a flexible coupling 60 having a first end 62 coupled to the first crank arm 38 and a second end 64 coupled to the foot support link 28. The second end 64 may be coupled to the foot support link 28 intermediate the forward and rearward ends. In the illustrated embodiment, the second end 64 is coupled to the foot support link close to the rearward end. The area between the forward end and rearward end of the foot support link may be considered a mid portion.

The flexible coupling 60 may be said to have a foot support portion 66 that extends upwardly from the second end 64 to a vertical control guide 68. In this embodiment, the vertical control guide 68 takes the form of a pulley that is supported on the upper portion 14 of the frame 12, near the rearward end of the upper portion 14. The vertical control guide 68 is located rearwardly of the first pivot axis 18 and the second pivot axis 36. As such, the vertical control guide is located on the rearward portion of the frame. As shown, the vertical control guide 68 is also above the second pivot axis 36 and on a similar level to the first pivot axis 18. The flexible coupling 60 then extends forwardly from the vertical control guide 68 to an upper pulley 70, then downwardly to a forward pulley 72 and then rearwardly to where the first end 62 connects to the crank arm 38. As shown, the upper pulley 70 may be on the upper portion and forward portion of the frame and the forward pulley may be on the forward portion of the frame below the upper pulley. In some embodiments, it is preferred that the flexible coupling 60 extend forwardly from where it connects to the crank system 34 so as to provide the desired motion profile. The flexible coupling may be routed or arranged differently than illustrated in alternative embodiments.

As shown in FIG. 1, the guide link 20 is generally parallel to the foot support portion 66 of the flexible coupling 60. Further, the distance between the first attachment point 22 (also the first pivot axis) and second attachment point 24 of the guide link 20 is similar to the the distance between the vertical control guide 68 and the second end 64 of the coupling 60. The second end 64 may be said to be attached to the foot support link at a coupling attachment point 64. This arrangement of pivots and attachments generally forms a parallelogram configuration. This configuration also exists in some other embodiments of the present invention.

One or more intermediate pulleys may be provided in addition to those that are illustrated, as desired to position the flexible coupling. In addition, in accordance with a further aspect of the present invention, provision may be made for changing the effective length of the flexible coupling, or the mechanical coupling, in any embodiment. This may be done to alter the motion profile of the foot receiving area. In the embodiment of FIG. 1, an optional retraction mechanism is shown at 180, which is operable to shorten the effectively length of the flexible coupling 60. The retraction mechanism 180 includes an intermediate pulley 182 engaging the flexible coupling 60 between the vertical control guide 68 and the upper pulley 70, though it may be located elsewhere. As will be clear to those of skill in the art, by moving the intermediate pulley 182 upwardly and downwardly, the effective length of the flexible coupling is changed. As the intermediate pulley 182 is moved downwardly, shortening the effective length, the foot support link 28 attached thereto is moved upwardly. This results in a modified motion profile, as shown at C. In the illustrated embodiment, the intermediate pulley 182 is moved by an arm 184, which is pivoted to the frame 12. The pulley may be supported in other ways, such as on a member that slides upwardly and downwardly. Movement of the pulley may be manual or powered. The retraction mechanism may take other forms, such as providing for adjusting the actual length of the flexible coupling. This may be accomplished by having an upper and lower portion in the foot support portion 66 and changing where the lower portion attaches to the upper portion. Alternatively, the attachment between the foot support portion 66 and the foot support link 28, shown at 64, may be made at different positions along the length of the flexible coupling.

As will be clear to those of skill in the art, as the crank system 34 rotates about the second pivot axis 36, the flexible coupling 60 moves the foot support link 28 upwardly and downwardly, specifically by pivoting the foot support link 28 about the attachment point 24 of the guide link 20. Put another way, the mechanical couplings each couple a respective one of the foot support links to the cranks system such that rotation of the crank system about the second pivot axis moves the foot support links in a path of travel having a substantially vertical component of motion. As the crank system 34 rotates about the second pivot axis 36, the flexible coupling 60 and the intermediate link 46 cooperate to cause the foot receiving area 32 of the foot support link to move along a closed generally elliptical path. This path may be considered to be "fixed" in that the path may not be changed by the user merely applying different forces to the foot receiving areas 32. Further, the horizontal and vertical components of motion are coupled such that the user may not vary the stride and length or switch between generally horizontal and vertical motions during use. However, the profile of the fixed and closed generally elliptical path may be changed by adjusting the exercise device in various ways. For example, the horizontal length of the horizontal component of travel and/or vertical height of the vertical component of travel maybe adjustable in various ways. The horizontal stride length may be adjusted by moving the third attachment point 44 inwardly and outwardly, to one of the other connecting points 56 on the connecting portion 42 of the guide link 20. Referring to FIG. 2, the crank arms 38 and 40 may be adjustable in various ways. If the positions of the connections to the flexible coupling and the intermediate links are both changed relative to the second pivot axis 36, the horizontal and vertical motions will both be changed. Alternatively, the system may allow for adjustment of the position of the connection of the first end 62 of the flexible coupling 60 to the crank arm 38, thereby allowing a change in the vertical height of the elliptical path. Alternative connection points are shown at 57. As a further alternative, the position where the second end 64 of the flexible coupling 60 is connected to the foot support link may be moved closer to or farther from the attachment 24. Alternative attachment points are shown at 65. This will change the extent of vertical movement of the foot receiving area 32. Changes to the third attachment point 50, the attachment of second end 64, and/or to the length of or connection to the crank arms may be made by manually adjusting connection points or by various adjustment mechanisms, either manual or powered. In FIG. 1, two exemplary motion paths are indicated at A and B. Other paths may also be provided depending on the configuration and relative positions of components of the device 10. The location of the vertical control guide 68 may also be adjustable to change the characteristics of the exercise device. Alternative connection points are shown at 69.

As mentioned above, the horizontal component of motion and the vertical component of motion are out of phase with each other. This means that when the horizontal component of motion of each foot support link is at its forwardmost or rearwardmost limit, the vertical component of motion of the same foot support link is approximately midway between its uppermost and lowermost limit. It is stated that the foot support link is "approximately midway" to indicate that the vertical and horizontal motions do not have to be exactly 90 degrees out of phase. The amount that they are out of phase may vary from 90 degrees in either direction, though in most embodiments it is close to 90 degrees. The out of phase movement is determined by how the mechanical couplings and intermediate links are coupled to the crank system. The mechanical couplings and intermediate links may be directly or indirectly coupled to the crank system. In FIG. 1, the mechanical couplings and intermediate links are both directly coupled to the crank system, by both being directly connected to one of the crank arms 38 and 40. Alternatively, one or both may be indirectly coupled, such as shown in some of the later embodiments. In FIG. 1, the first end of each mechanical coupling is connected to the same crank arm, at the same position, as the first end of the corresponding intermediate link. In this embodiment, the intermediate links extend generally vertically and the portion of the mechanical coupling attached to the crank system extends generally horizontally from the cranks system. This portion extends forwardly from the crank system in FIG. 1, but could extend rearwardly in other versions.

As shown in FIG. 1, the foot support links 28 may extend generally horizontally. The foot support portion 66 of the flexible coupling 60 extends generally vertically upwardly when the foot support links are midway through their horizontal travel, in the position shown in FIG. 1.

An elliptical exercise device may exhibit a variety of paths of foot motion, all of which may be considered to be "elliptical." Some such elliptical paths are more desirable than others. For example, some paths may be more comfortable or natural feeling to a user. Additionally, the velocity and acceleration of the foot receiving areas at various points along the path of motion will depend on the configuration of the exercise device. Preferred embodiments of the present invention provide a comfortable and natural feeling elliptical path with velocity and acceleration characteristics that provide for a comfortable user experience. In some embodiments, it is preferred that the horizontal component of motion of each foot support link has a higher acceleration when the support link is moving through its forward end of travel than when the foot support link is moving through its rearward end of travel.

Figure 3A:
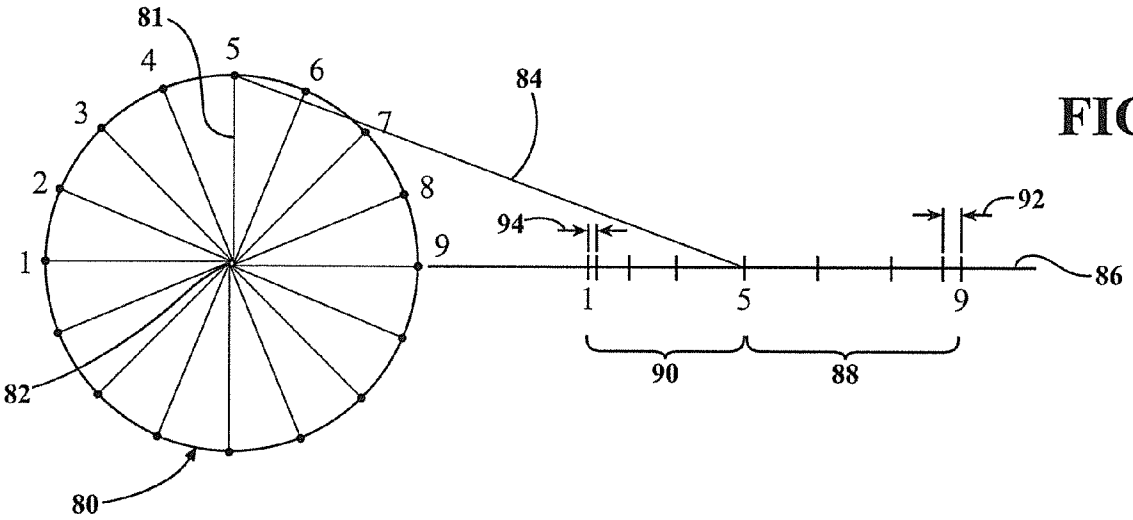
FIG. 3A is a schematic illustrating movement characteristics of a crank-slider mechanism.

FIG. 3A provides a schematic of a crank-slider mechanism to assist in explaining the motion characteristics of some embodiments of the present invention. FIG. 3A shows a circle 80 representing various rotational positions of an end of a crank arm on a crank that rotates about an axis 82. Various rotational positions of the crank are marked as 1-9, with each interval being separated by 22.5 degrees of rotation. A connecting arm 84 is shown connected to the crank 81 at the number 5 position and extends downwardly and forwardly to where it connects with a horizontal line 86. The forward end of the connecting arm 84 may be considered a slider. A crank-slider mechanism operates such that as the crank 81 rotates about the axis 82, the slider, which is connected to the crank 81 by the connecting arm 84, slides back and forth along the line 86. With the crank at position number 5, the connecting arm positions the slider at position 5 on line 86. As the crank 81 rotates clockwise, the slider will move to the right along line 86 until the slider is positioned at position 9 when the crank reaches position 9. As the crank continues to rotate, the slider will move back to position 1 when the crank reaches position 1. The hash marks between positions 1, 5, and 9 on the line 86 indicate the intermediate positions corresponding the locations marked as 2, 3, 4, and 6, 7, 8.

As shown, the hash marks are not evenly spaced along the line 86. Instead, the hash marks are closer to one another near positions 1 and 9. If the crank 80 rotates at a constant speed, the slider will travel at a higher rate of speed at locations where the hash marks are far apart and at lower rates of speed where the hash marks are closer to one another. As will be clear with reference to FIG. 3A, the distance of travel along line 86 is not symmetrical about position 5. Instead, the distance between position 5 and position 9, indicated at 88, is longer than the distance between position 1 and 5, as indicated at 90. As such, the speed of the slider is greater between positions 5 and 9 than it is between positions 1 and 5. A clear difference may also be seen in the distance between the hash mark at location 9 and the next adjacent hash mark versus the distance between the hash mark at position 1 and the next adjacent hash mark. The distance adjacent position 9, indicated at 92, is significantly larger than the distance adjacent position 1, indicated at 94. This means that the slider is moving faster adjacent position 9 than when it is adjacent position 1. An additional characteristic of the motion is that the slider changes directions at positions 1 and 9. As such, the velocity of the slider changes directions. Then, as the slider moves farther away from location 1 or 9, the velocity increases. As such, the rate of acceleration around positions 1 and 9 is greater than around position 5. Because the velocity is greater near position 9, the acceleration is also greater adjacent position 9 than adjacent position 1.

Preferred embodiments of the present invention are arranged such that the rate of acceleration of the foot receiving area is higher when the foot support link is moving through its forward end of travel than when the foot support link is moving through its rearward end of travel. Referring again to FIG. 1, the crank system 34 acts like the crank of FIG. 3A while the upper end 50 of the intermediate link 50 moves similarly to a slider. The motion in 50 is somewhat arcuate, but the characteristics of the motion are the same as discussed for FIG. 3A. That is, when the crank arm 38 is closest to the upper end of its travel, this corresponds to the slider in FIG. 3A being at position 9. This also corresponds to the guide link 20 being at its forward end of travel. As such, the rate of acceleration of the foot receiving area 32, with respect to the horizontal component of motion, is greatest when the foot receiving area is moving through its forward end of travel.

Figure 3B:
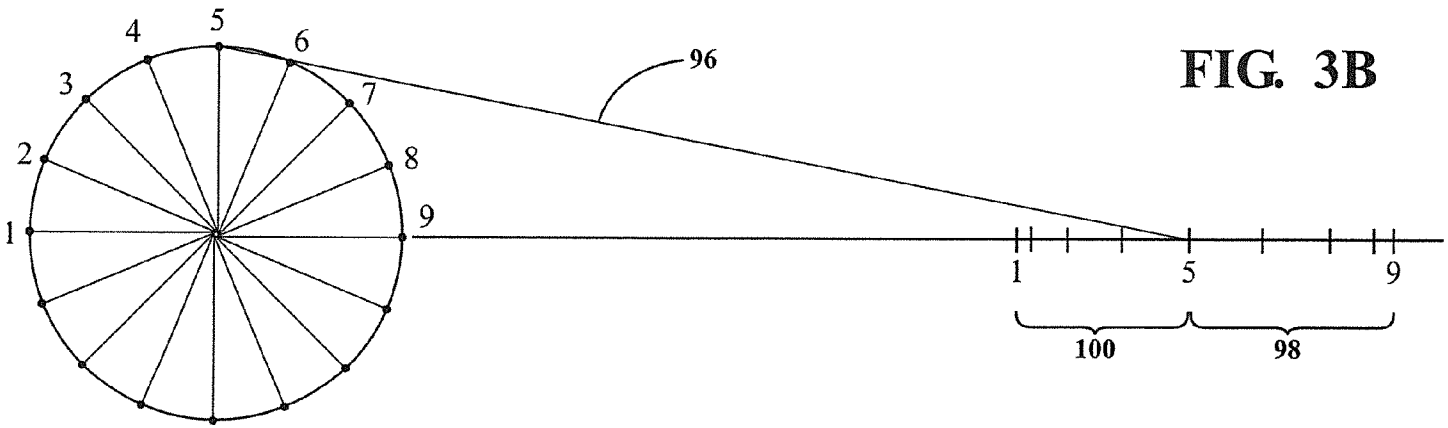
FIG. 3B is a schematic similar to FIG. 3A but with a longer connecting arm between the crank and slider.

Referring now to FIG. 3B, a schematic of a crank-slider mechanism similar to FIG. 3A is provided. However, this mechanism has a significantly longer connecting arm 96. The longer connecting arm changes the characteristics of the slider travel. Specifically, it reduces the differences between the travel between positions 1 and 5 and the travel between positions 5 and 9. The distance between positions 5 and 9, indicated at 98, is still greater than the distance between positions 1 and 5, indicated at 100. However, the difference between these distances is less than the difference between the distances 88 and 90. Likewise, the difference in velocity, and therefore acceleration, adjacent positions 1 and 9 is less than the configuration in FIG. 3A. The acceleration adjacent position 9 is still greater than the acceleration adjacent position 1, but the differences are reduced. This acts to smooth out the motion of the mechanism. Referring again to FIG. 1, some embodiments are configured so as to maximize the length of the intermediate links 46 and 52, giving a benefit similar to the change between the crank-slider mechanisms of FIGS. 3A and 3B. This positions the crank system 34 adjacent the lower end of the frame 12. In some versions, the length of the intermediate links 46 and 52 is at least 80% of the distance between the first attachment point 22 and second attachment point 24 of the guide links 20. As shown, the intermediate links are also generally vertical in this embodiment.

Figure 4:
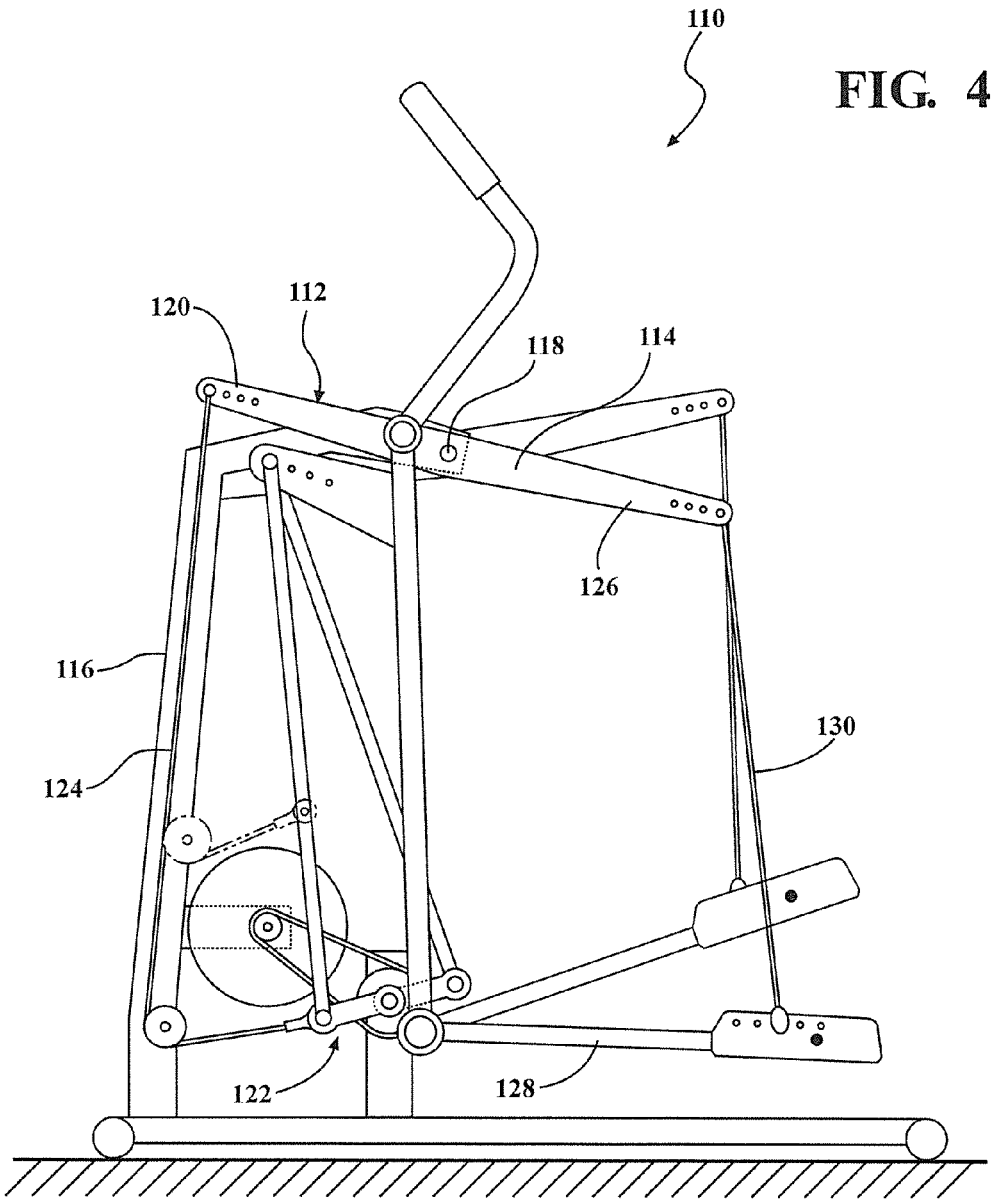
FIG. 4 is a side elevational view of a second embodiment of an elliptical exercise device in accordance with the present invention.

Referring now to FIG. 4, a second embodiment of an elliptical exercise device in accordance with the present invention is shown at 110. The exercise device 110 shares some components and characteristics with the exercise device 10 in FIG. 1. Only the components that differ will be described. Unlike the device 10 in FIG. 1, the elliptical exercise device 110 includes a mechanical coupling 112 that includes a rocker arm 114 pivotally connected to the frame 116 at pivot location 118. The rocker arm 114 has a forward end 120 that is coupled to the crank system 122 by a flexible element 124. A rearward end 126 of the rocker arm 114 is coupled to the foot support link 128 by a foot support portion 130, taking the form of another flexible element. As the crank system 122 rotates, the flexible element 124 causes the rocker arm 114 to pivot about the pivot location 118, thereby causing the foot support link 128 to move upwardly and downwardly. In this embodiment, the rearward end 126 of the rocker arm 126 acts as a vertical control guide. As with the embodiment of FIG. 1, the mechanical coupling 112 and intermediate links may be directly or indirectly coupled to the crank system.

Figure 6:
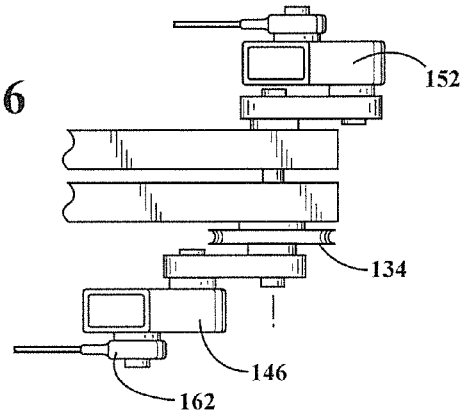
FIG. 6 is a cross sectional view taken along lines 6-6 of FIG. 5.
Figure 5:
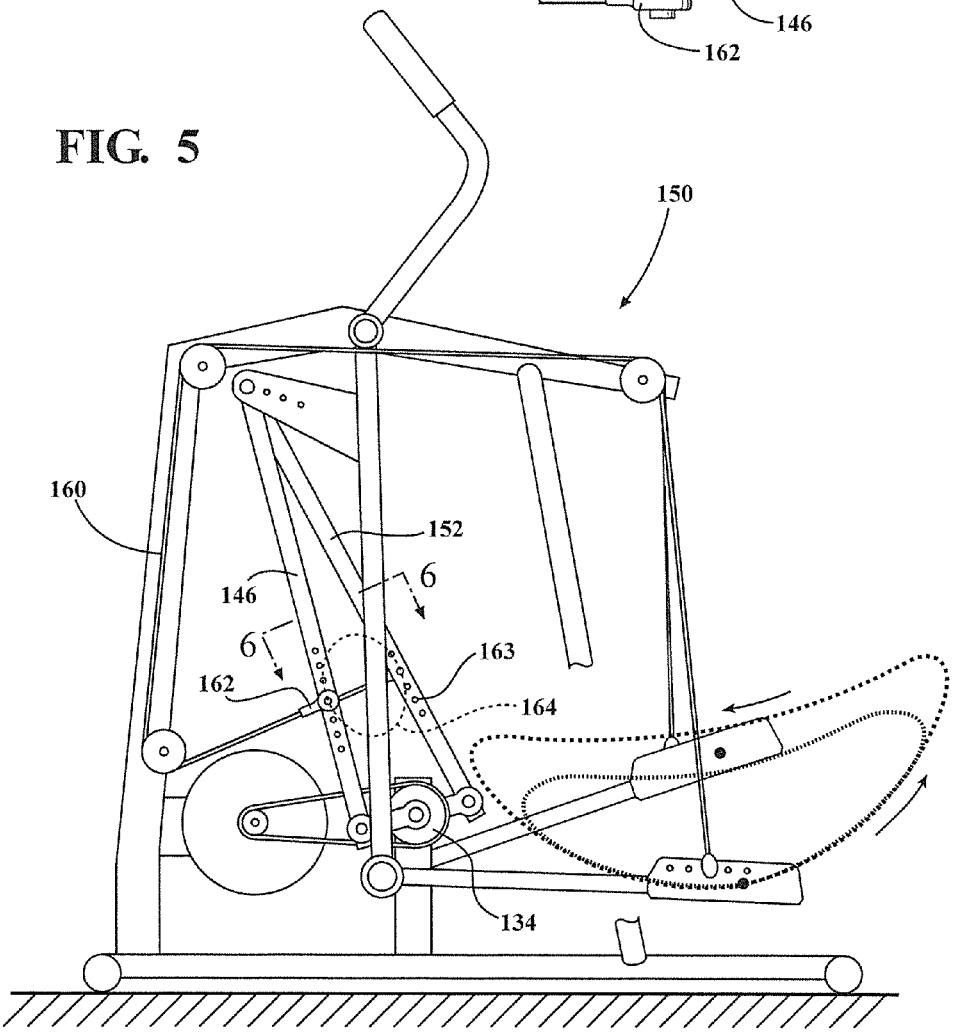
FIG. 5 is a side elevational view of a third embodiment of an elliptical exercise device in accordance with the present invention.

Referring now to FIGS. 5 and 6, a third embodiment of an elliptical exercise device in accordance with the present invention is shown at 150. The exercise device 150 shares some components and characteristics with the exercise device 10 in FIG. 1. Only the components that differ will be described. Unlike the device 10 in FIG. 1, the first end 162 of the flexible coupling 160 of the device 150 is attached to the first intermediate link 146, rather than being attached to the crank system 134. This is an example of an indirect coupling of the end 162 to the crank system, since the flexible coupling is coupled to the crank system by being connected to the intermediate link 146, which is connected to the crank system. The flexible coupling is coupled to the crank system through the intermediate link. This approach may be beneficial in some versions of the present invention, and provides a similar motion profile to the earlier versions. The approximate path of movement of the first end 162 is shown in dashed lines at 164. Thought not shown, the first end of the other flexible coupling would be attached to the second intermediate link 152. Alternative attachment points 163 may be provided for adjusting the vertical height of the vertical component of travel. Referring again to FIG. 4, an alternative attachment of the flexible coupling 124 to the intermediate links is shown in phantom lines.

FIG. 6 provides a cross sectional view taken along lines 6-6 of FIG. 5, showing the connection between the flexible couplings and the intermediate links.

Figure 8:
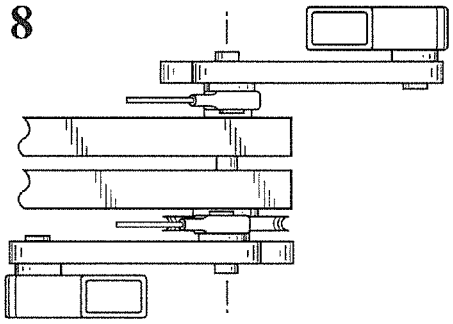
FIG. 8 is a cross sectional view taken along lines 8-8 of FIG. 7.
Figure 7:
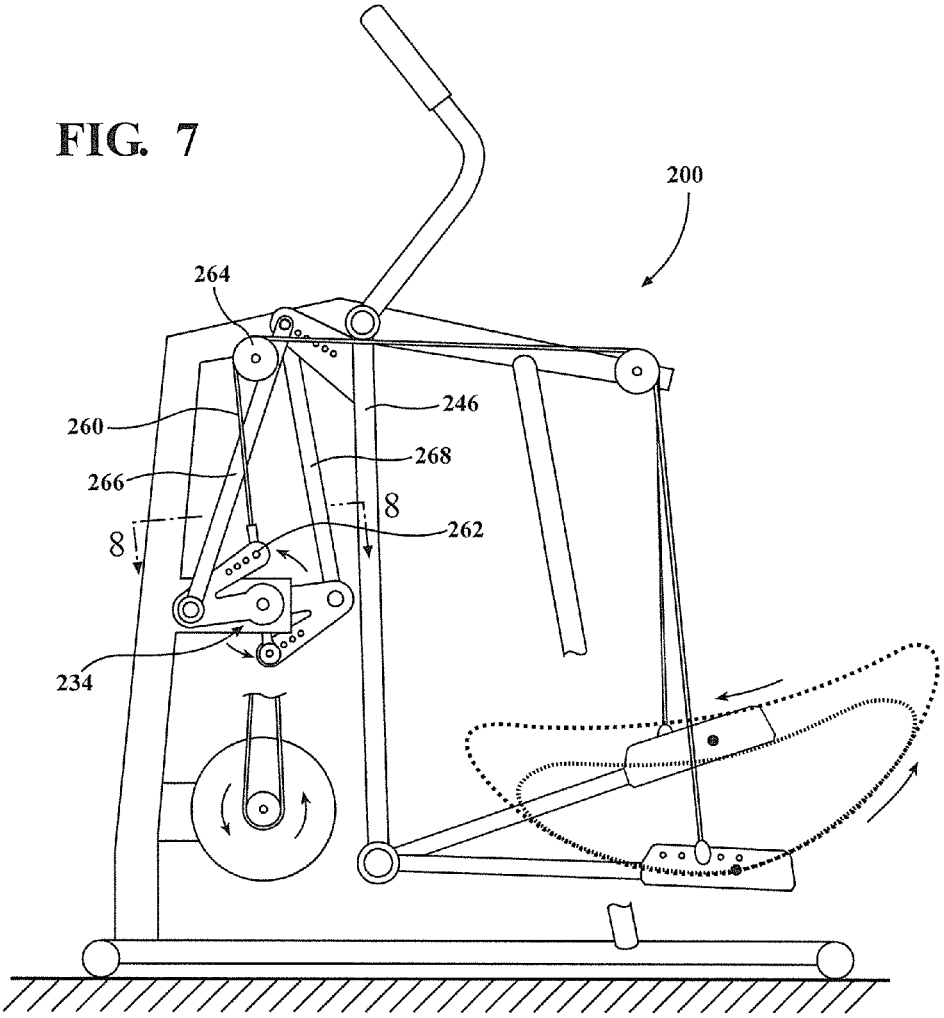
FIG. 7 is a side elevational view of a fourth embodiment of an elliptical exercise device in accordance with the present invention.

Referring now to FIGS. 7 and 8, a fourth embodiment of an elliptical exercise device in accordance with the present invention is shown at 200. The exercise device 200 shares some components and characteristics with the earlier embodiments. Only the components that differ will be described. Unlike the device 10 in FIG. 1, the crank system 234 of the device 200 has four connection points, spaced 90 degrees apart, as shown. The first end 262 of the first flexible coupling 260 is connected to one connection point and the lower end of the first intermediate link is connected to a connection point 90 degrees apart. The second flexible coupling and second intermediate link are connected to the two other connection points. In this embodiment, the flexible coupling may be said to extend generally vertically downwardly from an upper pulley 264 to the crank system. The intermediate links 266 and 268 may be said to extend generally vertically. The intermediate links in FIG. 7 are much shorter than the intermediate links in earlier embodiments. Alternatively, the crank system 234 may be moved downwardly to provide longer intermediate links, such as in FIG. 1.

It should be noted that mechanically equivalent components may be used in place of any of the links and/or cables, in any embodiment, as will be clear to those of skill in the art. FIG. 8 provides a cross sectional view taken along lines 8-8 of FIG. 7.

Figure 9:
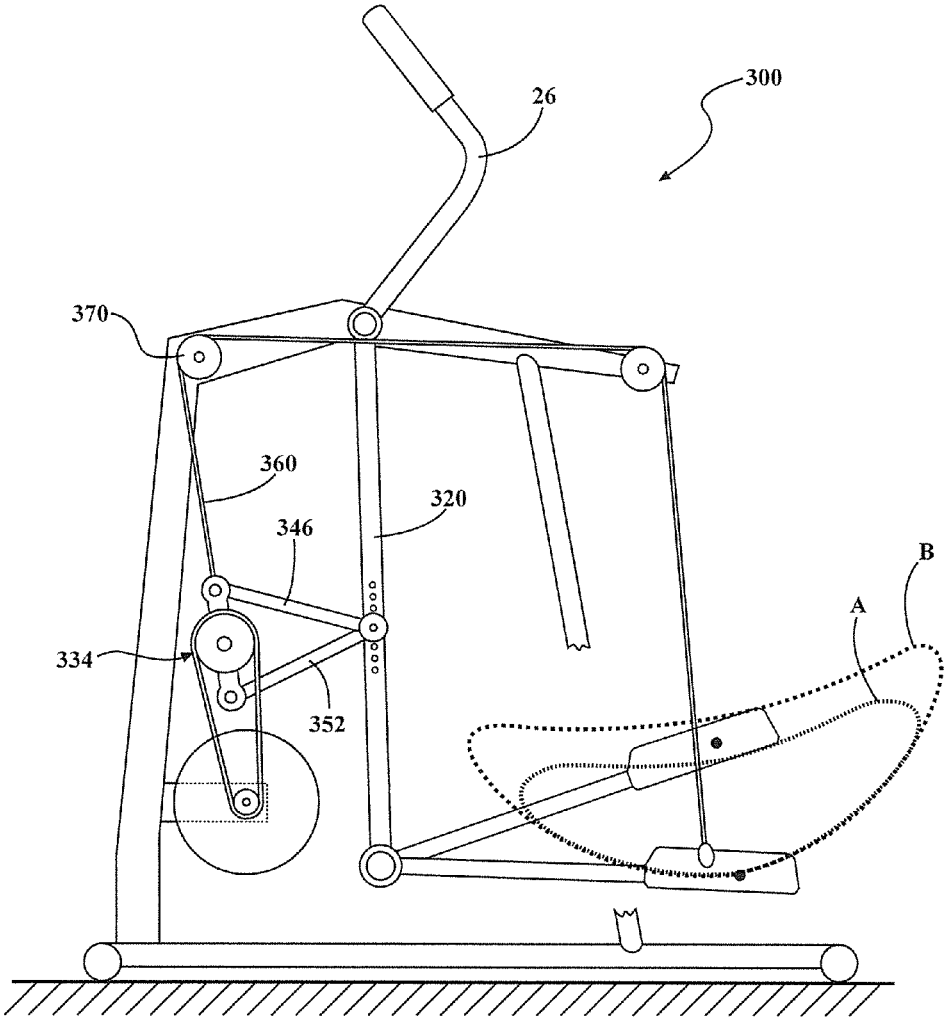
FIG. 9 is a side elevational view of a fifth embodiment of an elliptical exercise device in accordance with the present invention.

Referring now to FIG. 9, there is shown a fifth embodiment of an elliptical exercise device structured in accord with the present invention. The exercise device 300 shares some components and characteristics with the earlier embodiments. Only the components that differ will be described. Unlike the device 10 in FIG. 1, the device 300 has intermediate links 346 and 352 that extend generally horizontally from the cranks system 334 to the guide links 320. And, the flexible coupling 360 extends generally vertically downwardly from the upper pulley 370 to the crank system 334. As shown, the flexible coupling 360 is directly connected to the same crank arm as the corresponding intermediate link 346.

Figure 10:
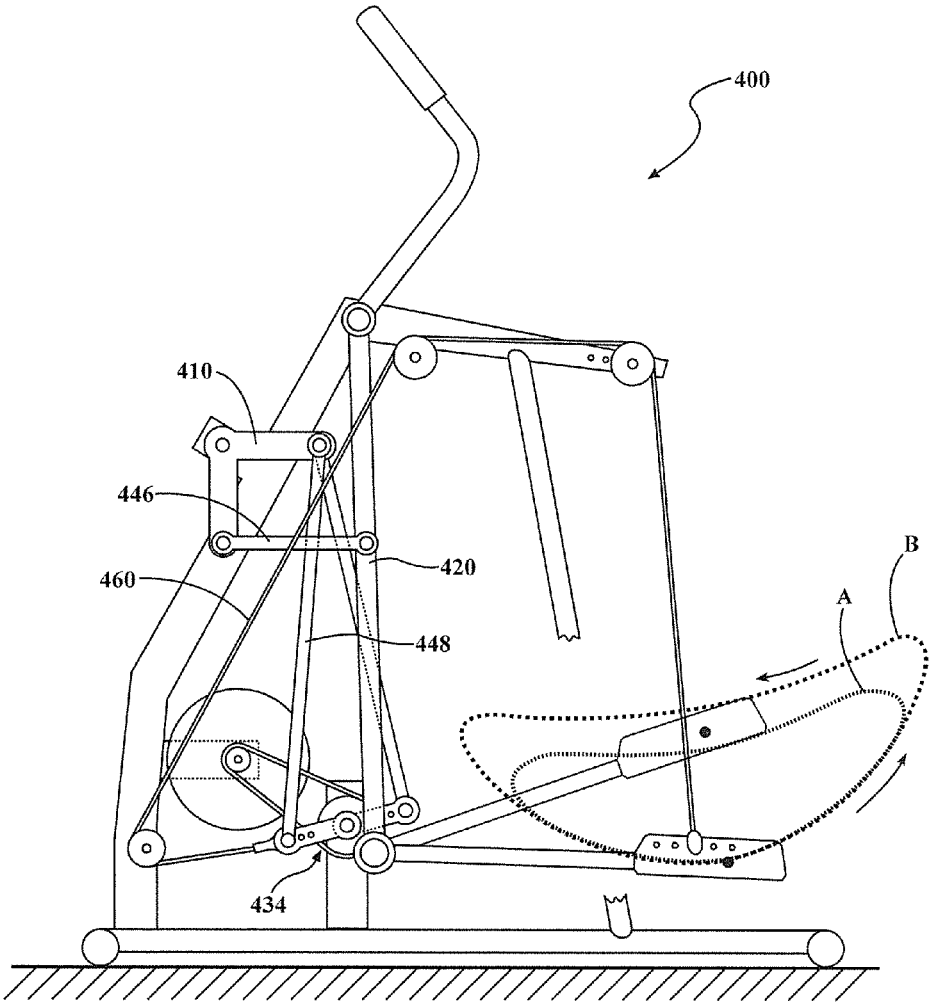
FIG. 10 is a side elevational view of a sixth embodiment of an elliptical exercise device in accordance with the present invention.

Referring now to FIG. 10, there is shown a sixth embodiment of an elliptical exercise device structured in accord with the present invention. The exercise device 400 shares some components and characteristics with the earlier embodiments. Only the components that differ will be described. Unlike the device 10 in FIG. 1, the device 400 has intermediate links 446 that are indirectly coupled to the crank system, through bell cranks. A first bell crank is shown at 410. The intermediate link 446 is connected to the guide link 420 at one end and the bell crank 410 at the other end. A coupling link 448 has one end connected to the bell crank 410 and the other connected to the crank system. Bell cranks or other indirect coupling approaches may be used in other ways as well.

The foregoing describes some particular embodiments of the present invention. Other embodiments, modifications, and variations thereof will be apparent to those of skill in the art in view of the teaching presented herein. The foregoing is not meant to be a limitation upon the practice of the present invention. For example, any feature of any of the embodiments disclosed herein may be used with any other feature or embodiment disclosed herein. It is the following claims, which include all equivalents, which define the scope of the invention.

The invention claimed is:

1. An elliptical exercise device comprising:

a frame configured to be supported on a horizontal surface, the frame having a first pivot axis and a second pivot axis defined thereon;

a first and a second guide link each having a first and a second attachment point defined thereon, each guide link being pivotally attached, through its first attachment point, to the frame at the first pivot axis thereof;

a first and a second foot support link each configured to support a user's foot thereupon, each foot support link being pivotally connected to the second attachment point of a respective one of the guide links so that when the guide links reciprocate relative to the frame, they each cause their respective foot support link to move in a path of travel having a horizontal component of motion;

a crank system pivotally attached to the frame at the second pivot axis thereof, the crank system being rotatable about the second pivot axis;

a first and a second mechanical coupling each coupling a respective one of the foot support links to the crank system such that rotation of the crank system about the second pivot axis moves the foot support links in a path of travel having a vertical component of motion, each mechanical coupling including a foot support portion connected to the corresponding foot support link at a coupling attachment point and extending upwardly from the respective one of the foot support links to engage a vertical control guide, each vertical control guide being disposed rearwardly of the first and second pivot axes and above the second pivot axis;

the corresponding first attachment point, second attachment point, vertical control guide, and coupling attachment point generally define vertices of a parallelogram when the coupling attachment point is at its lowest point during the path of travel;

a first and a second intermediate link each having a first end coupled to the crank system and a second end coupled to a respective one of the guide links such that rotation of the crank system about the second pivot axis causes the respective first and second guide links to pivot about the first pivot axis such that the foot support links move in the path of travel having a horizontal component of motion;

wherein the mechanical couplings and the intermediate links are coupled to the crank system such that the horizontal component of motion and the vertical component of motion are out of phase wherein when the horizontal component of motion of each foot support link is at its forwardmost or rearwardmost limit, the vertical component of motion of the same foot support link is approximately midway between its uppermost and lowermost limit;

whereby a foot receiving area of each foot support link moves in a generally elliptical path when the crank system rotates about the second pivot axis.

2. An exercise device in accordance with claim 1, wherein each vertical control guide is disposed on the frame.

3. An exercise device in accordance with claim 2, wherein each vertical control guide is a pulley rotationally mounted on the frame.

4. An exercise device in accordance with claim 2, wherein each mechanical coupling is a flexible element having a first end connected to the crank system, a second end connected to a respective one of the foot support links, and a midportion extending over one of the vertical control guides on the frame.

5. An exercise device in accordance with claim 4, further comprising:

the frame having a forward portion forward of the first pivot axis and a rearward portion rearward of the first pivot axis;

a first and a second forward pulley supported on the forward portion of the frame and forward of the second pivot axis;

the midportion of each of the flexible elements further extending over a respective one of the forward pulleys; and the first end of each flexible element extending rearwardly from the respective forward pulley to the crank system.

6. An exercise device in accordance with claim 5, further comprising:

a first and a second upper pulley supported on the forward portion of the frame and above the forward pulleys;

the midportion of each of the flexible elements further extending over a respective one of the upper pulleys; and the intermediate links extend generally vertically upwardly from the crank system.

7. An exercise device in accordance with claim 4, further comprising:

the frame having a forward portion forward of the first pivot axis and a rearward portion rearward of the first pivot axis.

a first and a second upper pulley supported on the forward portion of the frame and above the second pivot axis;

the midportion of each of the flexible elements further extending over a respective one of the upper pulleys;

the first end of each flexible element extending downwardly from the respective upper pulley to the crank system; and the intermediate links extend generally vertically upwardly from the crank system.

8. An exercise device in accordance with claim 7, wherein:

the crank system includes four attachment points disposed approximately 90 degrees apart; and the first ends of the mechanical couplings being coupled to two of the attachment points and the intermediate links being coupled to the other two of the attachment points.

9. An exercise device in accordance with claim 4, wherein the intermediate links extend generally rearwardly from the crank system.

10. An exercise device in accordance with claim 4, wherein the first end of each of the flexible elements is interconnected to the crank system by being connected to one of the intermediate links.

11. An exercise device in accordance with claim 4, wherein:

the crank system includes a first crank arm and a second crank arm;

the first end of each of the flexible elements is directly connected to one of the crank arms; and the first end of each intermediate link is connected to the same crank arm as the corresponding flexible element.

12. An exercise device in accordance with claim 1, wherein:

the crank system includes attachment points;

the mechanical couplings each having a first end directly connected to one of the attachment points; and the first end of each intermediate link being directly connected to one of the attachment points.

13. An exercise device in accordance with claim 1, wherein:

each of the guide links has a connecting portion extending forwardly to a third attachment point;

the second end of each of the intermediate links being connected to the third attachment point of a respective one of the guide links; and the intermediate links extend generally vertically.

14. An exercise device in accordance with claim 1, wherein:

the foot support portions of the mechanical couplings extend generally vertically when the foot support links are at middle position.

15. An exercise device in accordance with claim 1, wherein the intermediate links are indirectly coupled to the crank system.

16. An exercise device in accordance with claim 1, wherein:

each mechanical coupling includes a rocker arm pivotally interconnected with the frame, the rocker arm having a first end coupled to the crank system and a second end defining the vertical control guide.

17. An exercise device in accordance with claim 16, wherein:

each mechanical coupling further includes a flexible element extending from a respective one of the foot support links to a respective vertical control guide of the respective rocker arm.

18. An exercise device in accordance with claim 1, wherein:

the foot support links are generally horizontal, the connection between each foot support link and a respective one of the guide links being at a forward end of the foot support link, the foot receiving area being defined at a rearward end of each foot support link, and the foot support potion of each mechanical coupling being connected to a midportion of a respective one of the foot support links.

19. An exercise device in accordance with claim 1, wherein:

the guide links have a working length defined between the first attachment point and the second attachment point; and the intermediate links have a length that is at least 80% of the guide link working length.

20. An exercise device in accordance with claim 1, wherein:

the horizontal component of motion of each foot support link has a higher acceleration when the foot support link is moving through its forward end of travel than when the foot support link is moving through its rearward end of travel.

21. An exercise device in accordance with claim 1, wherein the vertical height of the vertical component of motion is adjustable.

22. An exercise device in accordance with claim 21, wherein:

the connection between each mechanical coupling and the crank system is adjustable with respect to the second pivot axis so as to change the vertical height of the vertical component of motion.

23. An exercise device in accordance with claim 1, wherein the horizontal length of the horizontal component of motion is adjustable.

24. An exercise device in accordance with claim 23, wherein:

each of the guide links has a third attachment point defined thereon;

the second end of each of the intermediate links being connected to the third attachment point of a respective one of the guide links; and the third attachment points being adjustable so as to change the horizontal length of the horizontal component of motion.

25. An exercise device in accordance with claim 1, wherein:

the guide links each include hand portions extending upwardly from the first attachment point.

26. An exercise device in accordance with claim 1, wherein:

the crank system has a first and a second crank arm;

the first end of each intermediate link being connected to a respective one of the crank arms; and each of the mechanical couplings being coupled to a respective one of the crank arms.

27. An exercise device in accordance with claim 1, further comprising:

a retraction mechanism for changing the effective length of the mechanical couplings such that the position of each foot support link relative to the corresponding guide link is altered, thereby altering a motion profile of each foot receiving area;

the retraction mechanism having a first and second intermediate pulley each engaging one of the mechanical couplings and moveable so as to change the effective length of the mechanical coupling.

28. An exercise device comprising:

a frame configured to be supported on a horizontal surface, the frame having a first pivot axis, a second pivot axis, and a first and second vertical control guide defined thereon, each vertical control guide being disposed rearwardly of the first and second pivot axes;

a first and a second guide link each having a first and a second attachment point defined thereon, each guide link being pivotally attached, through its first attachment point, to the frame at the first pivot axis thereof;

a first and a second foot support link each configured to support a user's foot thereupon, each foot support link being pivotally connected to the second attachment point of a respective one of the guide links so that when the guide links reciprocate relative to the frame, they each cause their respective foot support link to move in a path of travel having a horizontal component of motion;

a crank system pivotally attached to the frame at the second pivot axis thereof, the crank system being rotatable about the second pivot axis;

a first and a second flexible coupling each coupling a respective one of the foot support links to the crank system such that rotation of the crank system about the second pivot axis moves the foot support links in a path of travel having a vertical component of motion, each flexible coupling including a foot support portion connected to the corresponding foot support link at a coupling attachment point and extending upwardly from the respective one of the foot support links to engage a respective one of the vertical control guides, each foot support portion being generally parallel with the respective one of the guide links;

the corresponding first attachment point, second attachment point, vertical control guide, and coupling attachment point generally define vertices of a parallelogram when the coupling attachment point is at its lowest point during the path of travel;

a first and a second intermediate link each having a first end coupled to the crank system and a second end coupled to a respective one of the guide links such that rotation of the crank system about the second pivot axis causes the respective first and second guide links to pivot about the first pivot axis such that the foot support links move in the path of travel having a horizontal component of motion;

wherein the flexible couplings and the intermediate links are coupled to the crank system such that the horizontal component of motion and the vertical component of motion are out of phase wherein when the horizontal component of motion of each foot support link is at its forwardmost or rearwardmost limit, the vertical component of motion of the same foot support link is approximately midway between its uppermost and lowermost limit;

whereby a foot receiving area of each foot support link moves in an elliptical path when the crank system rotates about the second pivot axis.

29. An elliptical exercise device comprising:

a frame configured to be supported on a horizontal surface, the frame having a first pivot axis and a second pivot axis defined thereon;

a first and a second guide link each having a first and a second attachment point defined thereon, each guide link being pivotally attached, through its first attachment point, to the frame at the first pivot axis thereof;

a first and a second foot support link each configured to support a user's foot thereupon, each foot support link being pivotally connected to the second attachment point of a respective one of the guide links so that when the guide links reciprocate relative to the frame, they each cause their respective foot support link to move in a path of travel having a horizontal component of motion;

a crank system pivotally attached to the frame at the second pivot axis thereof, the crank system being rotatable about the second pivot axis;

a first and a second mechanical coupling each coupling a respective one of the foot support links to the crank system such that rotation of the crank system about the second pivot axis moves the foot support links in a path of travel having a vertical component of motion, each mechanical coupling including a foot support portion connected to the corresponding foot support link at a coupling attachment point and extending upwardly from the respective one of the foot support links to engage a vertical control guide, each vertical control guide being disposed rearwardly of the first and second pivot axes and above the second pivot axis;

a first and a second intermediate link each having a first end coupled to the crank system and a second end coupled to a respective one of the guide links such that rotation of the crank system about the second pivot axis causes the respective first and second guide links to pivot about the first pivot axis such that the foot support links move in the path of travel having a horizontal component of motion;

wherein the mechanical couplings and the intermediate links are coupled to the crank system such that the horizontal component of motion and the vertical component of motion are out of phase wherein when the horizontal component of motion of each foot support link is at its forwardmost or rearwardmost limit, the vertical component of motion of the same foot support link is approximately midway between its uppermost and lowermost limit;

wherein the coupling attachment point of each foot support link remains rearward of the first pivot axis throughout a path of travel of the foot support links;

whereby a foot receiving area of each foot support link moves in a generally elliptical path when the crank system rotates about the second pivot axis.

30. An exercise device in accordance with claim 29, wherein each vertical control guide is disposed on the frame.

31. An exercise device in accordance with claim 30, wherein each vertical control guide is a pulley rotationally mounted on the frame.

32. An exercise device in accordance with claim 30, wherein each mechanical coupling is a flexible element having a first end connected to the crank system, a second end connected to a respective one of the foot support links, and a midportion extending over one of the vertical control guides on the frame.

33. An exercise device in accordance with claim 32, further comprising:

the frame having a forward portion forward of the first pivot axis and a rearward portion rearward of the first pivot axis;

a first and a second forward pulley supported on the forward portion of the frame and forward of the second pivot axis;

the midportion of each of the flexible elements further extending over a respective one of the forward pulleys; and the first end of each flexible element extending rearwardly from the respective forward pulley to the crank system.

34. An exercise device in accordance with claim 33, further comprising:

a first and a second upper pulley supported on the forward portion of the frame and above the forward pulleys;

the midportion of each of the flexible elements further extending over a respective one of the upper pulleys; and the intermediate links extend generally vertically upwardly from the crank system.

35. An exercise device in accordance with claim 32, further comprising:

the frame having a forward portion forward of the first pivot axis and a rearward portion rearward of the first pivot axis.

a first and a second upper pulley supported on the forward portion of the frame and above the second pivot axis;

the midportion of each of the flexible elements further extending over a respective one of the upper pulleys;

the first end of each flexible element extending downwardly from the respective upper pulley to the crank system; and the intermediate links extend generally vertically upwardly from the crank system.

36. An exercise device in accordance with claim 35, wherein:

the crank system includes four attachment points disposed approximately 90 degrees apart; and the first ends of the mechanical couplings being coupled to two of the attachment points and the intermediate links being coupled to the other two of the attachment points.

37. An exercise device in accordance with claim 32, wherein the intermediate links extend generally rearwardly from the crank system.

38. An exercise device in accordance with claim 33, wherein the first end of each of the flexible elements is interconnected to the crank system by being connected to one of the intermediate links.

39. An exercise device in accordance with claim 32, wherein:

the crank system includes a first crank arm and a second crank arm;

the first end of each of the flexible elements is directly connected to one of the crank arms; and the first end of each intermediate link is connected to the same crank arm as the corresponding flexible element.

40. An exercise device in accordance with claim 29, wherein:

the crank system includes attachment points;

the mechanical couplings each having a first end directly connected to one of the attachment points; and the first end of each intermediate link being directly connected to one of the attachment points.

41. An exercise device in accordance with claim 29, wherein:

each of the guide links has a connecting portion extending forwardly to a third attachment point;

the second end of each of the intermediate links being connected to the third attachment point of a respective one of the guide links; and the intermediate links extend generally vertically.

42. An exercise device in accordance with claim 29, wherein:

the foot support portions of the mechanical couplings extend generally vertically when the foot support links are at middle position.

43. An exercise device in accordance with claim 29, wherein the intermediate links are indirectly coupled to the crank system.

44. An exercise device in accordance with claim 29, wherein:

each mechanical coupling includes a rocker arm pivotally interconnected with the frame, the rocker arm having a first end coupled to the crank system and a second end defining the vertical control guide.

45. An exercise device in accordance with claim 44, wherein:

each mechanical coupling further includes a flexible element extending from a respective one of the foot support links to a respective vertical control guide of the respective rocker arm.

46. An exercise device in accordance with claim 29, wherein:

the foot support links are generally horizontal, the connection between each foot support link and a respective one of the guide links being at a forward end of the foot support link, the foot receiving area being defined at a rearward end of each foot support link, and the foot support potion of each mechanical coupling being connected to a midportion of a respective one of the foot support links.

47. An exercise device in accordance with claim 29, wherein:

the guide links have a working length defined between the first attachment point and the second attachment point; and the intermediate links have a length that is at least 80% of the guide link working length.

48. An exercise device in accordance with claim 29, wherein:

the horizontal component of motion of each foot support link has a higher acceleration when the foot support link is moving through its forward end of travel than when the foot support link is moving through its rearward end of travel.

49. An exercise device in accordance with claim 29, wherein the vertical height of the vertical component of motion is adjustable.

50. An exercise device in accordance with claim 49, wherein:

the connection between each mechanical coupling and the crank system is adjustable with respect to the second pivot axis so as to change the vertical height of the vertical component of motion.

51. An exercise device in accordance with claim 29, wherein the horizontal length of the horizontal component of motion is adjustable.

52. An exercise device in accordance with claim 51, wherein:

each of the guide links has a third attachment point defined thereon;

the second end of each of the intermediate links being connected to the third attachment point of a respective one of the guide links; and the third attachment points being adjustable so as to change the horizontal length of the horizontal component of motion.

53. An exercise device in accordance with claim 29, wherein:

the guide links each include hand portions extending upwardly from the first attachment point.

54. An exercise device in accordance with claim 29, wherein:

the crank system has a first and a second crank arm;

the first end of each intermediate link being connected to a respective one of the crank arms; and each of the mechanical couplings being coupled to a respective one of the crank arms.

55. An exercise device in accordance with claim 29, further comprising:

a retraction mechanism for changing the effective length of the mechanical couplings such that the position of each foot support link relative to the corresponding guide link is altered, thereby altering a motion profile of each foot receiving area;

the retraction mechanism having a first and second intermediate pulley each engaging one of the mechanical couplings and moveable so as to change the effective length of the mechanical coupling.

56. An elliptical exercise device comprising:

a frame configured to be supported on a horizontal surface, the frame having a first pivot axis and a second pivot axis defined thereon, the frame further having a forward portion forward of the first pivot axis and a rearward portion rearward of the first pivot axis;

a first and a second forward pulley supported on the forward portion of the frame and forward of the second pivot axis;

a first and a second guide link each having a first and a second attachment point defined thereon, each guide link being pivotally attached, through its first attachment point, to the frame at the first pivot axis thereof;

a first and a second foot support link each configured to support a user's foot thereupon, each foot support link being pivotally connected to the second attachment point of a respective one of the guide links so that when the guide links reciprocate relative to the frame, they each cause their respective foot support link to move in a path of travel having a horizontal component of motion;

a crank system pivotally attached to the frame at the second pivot axis thereof, the crank system being rotatable about the second pivot axis;

a first and a second flexible element each coupling a respective one of the foot support links to the crank system such that rotation of the crank system about the second pivot axis moves the foot support links in a path of travel having a vertical component of motion, each flexible element including a foot support portion extending upwardly from a respective one of the foot support links to engage a vertical control guide, each vertical control guide being disposed on the frame rearwardly of the first and second pivot axes and above the second pivot axis, each flexible element having a first end connected to the crank system, a second end connected to the respective one of the foot support links, and a midportion extending over one of the vertical control guides on the frame and over a respective one of the forward pulleys, the first end of each flexible element extending rearwardly from the respective forward pulley to the crank system;

a first and a second intermediate link each having a first end coupled to the crank system and a second end coupled to a respective one of the guide links such that rotation of the crank system about the second pivot axis causes the respective first and second guide links to pivot about the first pivot axis such that the foot support links move in the path of travel having a horizontal component of motion;

wherein the flexible elements and the intermediate links are coupled to the crank system such that the horizontal component of motion and the vertical component of motion are out of phase wherein when the horizontal component of motion of each foot support link is at its forwardmost or rearwardmost limit, the vertical component of motion of the same foot support link is approximately midway between its uppermost and lowermost limit;

whereby a foot receiving area of each foot support link moves in a generally elliptical path when the crank system rotates about the second pivot axis.

57. An exercise device in accordance with claim 56, wherein each vertical control guide is a pulley rotationally mounted on the frame.

58. An exercise device in accordance with claim 56, further comprising:

a first and a second upper pulley supported on the forward portion of the frame and above the forward pulleys;

the midportion of each of the flexible elements further extending over a respective one of the upper pulleys; and the intermediate links extend generally vertically upwardly from the crank system.

59. An exercise device in accordance with claim 56, wherein:

the crank system includes attachment points;

the flexible elements each having a first end directly connected to one of the attachment points; and the first end of each intermediate link being directly connected to one of the attachment points.

60. An exercise device in accordance with claim 56, wherein:

each of the guide links has a connecting portion extending forwardly to a third attachment point;

the second end of each of the intermediate links being connected to the third attachment point of a respective one of the guide links; and the intermediate links extend generally vertically.

61. An exercise device in accordance with claim 56, wherein:

the foot support portions of the flexible elements extend generally vertically when the foot support links are at middle position.

62. An exercise device in accordance with claim 56, wherein the intermediate links are indirectly coupled to the crank system.

63. An exercise device in accordance with claim 56, wherein:

the foot support links are generally horizontal, the connection between each foot support link and a respective one of the guide links being at a forward end of the foot support link, the foot receiving area being defined at a rearward end of each foot support link, and the foot support potion of each flexible element being connected to a midportion of a respective one of the foot support links.

64. An exercise device in accordance with claim 56, wherein:

the guide links have a working length defined between the first attachment point and the second attachment point; and the intermediate links have a length that is at least 80% of the guide link working length.

65. An exercise device in accordance with claim 56, wherein:

the horizontal component of motion of each foot support link has a higher acceleration when the foot support link is moving through its forward end of travel than when the foot support link is moving through its rearward end of travel.

66. An elliptical exercise device comprising:

a frame configured to be supported on a horizontal surface, the frame having a first pivot axis and a second pivot axis defined thereon;

a first and a second guide link each having a first and a second attachment point defined thereon, each guide link being pivotally attached, through its first attachment point, to the frame at the first pivot axis thereof, the guide links having a working length defined between the first attachment point and the second attachment point;

a first and a second foot support link each configured to support a user's foot thereupon, each foot support link being pivotally connected to the second attachment point of a respective one of the guide links so that when the guide links reciprocate relative to the frame, they each cause their respective foot support link to move in a path of travel having a horizontal component of motion;

a crank system pivotally attached to the frame at the second pivot axis thereof, the crank system being rotatable about the second pivot axis;

a first and a second mechanical coupling each coupling a respective one of the foot support links to the crank system such that rotation of the crank system about the second pivot axis moves the foot support links in a path of travel having a vertical component of motion, each mechanical coupling including a foot support portion extending upwardly from a respective one of the foot support links to engage a vertical control guide, each vertical control guide being disposed rearwardly of the first and second pivot axes and above the second pivot axis;

a first and a second intermediate link each having a first end coupled to the crank system and a second end coupled to a respective one of the guide links such that rotation of the crank system about the second pivot axis causes the respective first and second guide links to pivot about the first pivot axis such that the foot support links move in the path of travel having a horizontal component of motion, the intermediate links having a length that is at least 80% of the guide link working length;

wherein the mechanical couplings and the intermediate links are coupled to the crank system such that the horizontal component of motion and the vertical component of motion are out of phase wherein when the horizontal component of motion of each foot support link is at its forwardmost or rearwardmost limit, the vertical component of motion of the same foot support link is approximately midway between its uppermost and lowermost limit;

whereby a foot receiving area of each foot support link moves in a generally elliptical path when the crank system rotates about the second pivot axis.

67. An exercise device in accordance with claim 66, wherein each vertical control guide is disposed on the frame.

68. An exercise device in accordance with claim 67, wherein each vertical control guide is a pulley rotationally mounted on the frame.

69. An exercise device in accordance with claim 67, wherein each mechanical coupling is a flexible element having a first end connected to the crank system, a second end connected to a respective one of the foot support links, and a midportion extending over one of the vertical control guides on the frame.

70. An exercise device in accordance with claim 69, wherein the first end of each of the flexible elements is interconnected to the crank system by being connected to one of the intermediate links.

71. An exercise device in accordance with claim 69, wherein:

the crank system includes a first crank arm and a second crank arm;

the first end of each of the flexible elements is directly connected to one of the crank arms; and the first end of each intermediate link is connected to the same crank arm as the corresponding flexible element.

72. An exercise device in accordance with claim 66, wherein:

the crank system includes attachment points;

the mechanical couplings each having a first end directly connected to one of the attachment points; and the first end of each intermediate link being directly connected to one of the attachment points.

73. An exercise device in accordance with claim 66, wherein:

each of the guide links has a connecting portion extending forwardly to a third attachment point;

the second end of each of the intermediate links being connected to the third attachment point of a respective one of the guide links; and the intermediate links extend generally vertically.

74. An exercise device in accordance with claim 66, wherein:

the foot support portions of the mechanical couplings extend generally vertically when the foot support links are at middle position.

75. An exercise device in accordance with claim 66, wherein:

each mechanical coupling includes a rocker arm pivotally interconnected with the frame, the rocker arm having a first end coupled to the crank system and a second end defining the vertical control guide;

each mechanical coupling further includes a flexible element extending from a respective one of the foot support links to a respective vertical control guide of the respective rocker arm.

76. An exercise device in accordance with claim 66, wherein:

the foot support links are generally horizontal, the connection between each foot support link and a respective one of the guide links being at a forward end of the foot support link, the foot receiving area being defined at a rearward end of each foot support link, and the foot support potion of each mechanical coupling being connected to a midportion of a respective one of the foot support links.

77. An exercise device in accordance with claim 66, wherein:

the horizontal component of motion of each foot support link has a higher acceleration when the foot support link is moving through its forward end of travel than when the foot support link is moving through its rearward end of travel.

78. An exercise device in accordance with claim 66, wherein:

the connection between each mechanical coupling and the crank system is adjustable with respect to the second pivot axis so as to change the vertical height of the vertical component of motion.

79. An exercise device in accordance with claim 66, wherein:

each of the guide links has a third attachment point defined thereon;

the second end of each of the intermediate links being connected to the third attachment point of a respective one of the guide links; and the third attachment points being adjustable so as to change the horizontal length of the horizontal component of motion.

80. An exercise device in accordance with claim 66, wherein:

the crank system has a first and a second crank arm;

the first end of each intermediate link being connected to a respective one of the crank arms; and each of the mechanical couplings being coupled to a respective one of the crank arms.

* * * * *